US011535354B2

(12) United States Patent
Yamamoto et al.

(10) Patent No.: US 11,535,354 B2
(45) Date of Patent: Dec. 27, 2022

(54) CONTROL SYSTEM FOR OUTBOARD MOTOR

(71) Applicant: HONDA MOTOR CO., LTD., Tokyo (JP)

(72) Inventors: Hiroshi Yamamoto, Wako (JP); Akifumi Fujima, Wako (JP); Yoshihiro Harada, Wako (JP)

(73) Assignee: HONDA MOTOR CO., LTD., Tokyo (JP)

( * ) Notice: Subject to any disclaimer, the term of this patent is extended or adjusted under 35 U.S.C. 154(b) by 63 days.

(21) Appl. No.: 17/258,561

(22) PCT Filed: Jul. 12, 2018

(86) PCT No.: PCT/JP2018/026334
§ 371 (c)(1),
(2) Date: Jan. 7, 2021

(87) PCT Pub. No.: WO2020/012602
PCT Pub. Date: Jan. 16, 2020

(65) Prior Publication Data

US 2021/0291948 A1 Sep. 23, 2021

(51) Int. Cl.
*B63H 20/10* (2006.01)
*B63H 25/04* (2006.01)
*G08G 3/02* (2006.01)

(52) U.S. Cl.
CPC ..... *B63H 20/10* (2013.01); *B63H 25/04* (2013.01); *G08G 3/02* (2013.01)

(58) Field of Classification Search
CPC ..... B63H 20/00; B63H 20/10; B63H 25/00; B63H 25/04; G08G 3/00; G08G 3/02
(Continued)

(56) References Cited

U.S. PATENT DOCUMENTS 6,801,839 B2 * 10/2004 Kaji ..... G05D 1/0206 701/21
9,862,473 B2 * 1/2018 Rydberg ..... B63H 20/10
(Continued)

FOREIGN PATENT DOCUMENTS

JP S55-87898 6/1980
JP S61-44381 3/1986
(Continued)

OTHER PUBLICATIONS

International Search Report, dated Nov. 9, 2018, 2 pages.

*Primary Examiner* — Lars A Olson
(74) *Attorney, Agent, or Firm* — Rankin, Hill & Clark LLP

(57) ABSTRACT

A control system for an outboard motor is provided which enables safe navigation over a shoal. A control system for an outboard motor including a propeller includes: a trim angle adjustment motor for changing the attitude of the outboard motor with respect to a watercraft; and a controller configured to selectively implement first control that operates the trim angle adjustment motor and controls the vertical position of the propeller to a first position, and second control that operates the trim angle adjustment motor and controls the vertical position of the propeller to a second position closer to a water surface than the first position. The controller acquires information on the depth of water a predetermined distance ahead in the travel direction of the watercraft, and determines which of the first control and the second control is implemented, on the basis of at least the information on the depth of water.

11 Claims, 12 Drawing Sheets

(58) Field of Classification Search
USPC ..... 440/1
See application file for complete search history.

(56) References Cited

U.S. PATENT DOCUMENTS

| | | | | |
|---|---|---|---|---|
| 10,281,928 | B2 * | 5/2019 | Behling | B63H 20/10 |
| 10,717,503 | B2 * | 7/2020 | Sampson | B63H 20/10 |
| 2003/0220724 | A1 | 11/2003 | Kaji | |
| 2006/0079140 | A1 | 4/2006 | Muller | |
| 2016/0288893 | A1 | 10/2016 | Rydberg et al. | |
| 2017/0158297 | A1 | 6/2017 | Sampson | |

FOREIGN PATENT DOCUMENTS

| | | |
|---|---|---|
| JP | H07-47992 | 2/1995 |
| JP | H09-156586 | 6/1997 |
| JP | 2000-182199 | 6/2000 |
| JP | 2003-341592 | 12/2003 |

* cited by examiner

CONTROL SYSTEM FOR OUTBOARD MOTOR

TECHNICAL FIELD

The present invention relates to a control system for an outboard motor.

BACKGROUND ART

Patent Literature 1 describes a grounding alarm apparatus that is applied to a navigation support system for watercraft. The grounding alarm apparatus checks a virtual electronic chart created on the basis of the travel direction of a watercraft for the presence of a shoal within a grounding risk distance in the travel direction of the watercraft and, if a shoal is present and the watercraft has approached the shoal, judges that there is a risk of grounding, and generates an alarm.

Patent Literature 2 describes a sea bottom line display apparatus that displays various images in a state where a relative relationship with a sea bottom line cut in a vertical direction is easy to understand, and supports safe navigation, fishing and the like.

CITATION LIST

Patent Literature

PATENT LITERATURE 1: JP-A-07-47992
PATENT LITERATURE 2; JP-A-61-44381

SUMMARY OF INVENTION

Problems to be Solved by Invention

It is preferable that a watercraft avoid navigation over a shoal where a mounted propeller may come into contact with a sea bottom. Hence, as described in Patent Literature 1, it is effective for safe navigation to previously grasp the presence or absence of a shoal on a route. However, if it is possible to safely navigate over a shoal, it is possible to reduce a navigation distance to a destination and to improve ride comfort, eliminating frequent changes in the travel direction.

Patent Literature 1 describes generating an alarm if a watercraft approaches a shoal, but does not take into consideration a case where a watercraft navigates over a shoal. Patent Literature 2 does not describe judging the presence or absence of a shoal in the travel direction of a watercraft and does not take into consideration a case of navigating over a shoal.

The present invention has been made considering the above circumstances, and an object thereof is to provide an outboard motor control system that enables safe navigation over a shoal.

Solution to Problems

A control system for an outboard motor according to the present invention includes a propeller and is attached to a stern of a watercraft, the control system including: a driver for changing the attitude of the outboard motor with respect to the Watercraft; and a controller configured to selectively implement first control that operates the driver and controls the vertical position of the propeller to a first position, and second control that operates the driver and controls the vertical position of the propeller to a second position closer to a water surface than the first position, wherein the controller acquires information on the depth of water a predetermined distance ahead in the travel direction of the watercraft, and determines which of the first control and the second control is implemented, on the basis of at least the information on the depth of water.

Effects of Invention

According to the present invention, it is possible to provide an outboard motor control system that enables safe navigation over a shoal.

DESCRIPTION OF EMBODIMENTS

Embodiments of the present invention are described hereinafter with reference to the drawings.

Figure 1:
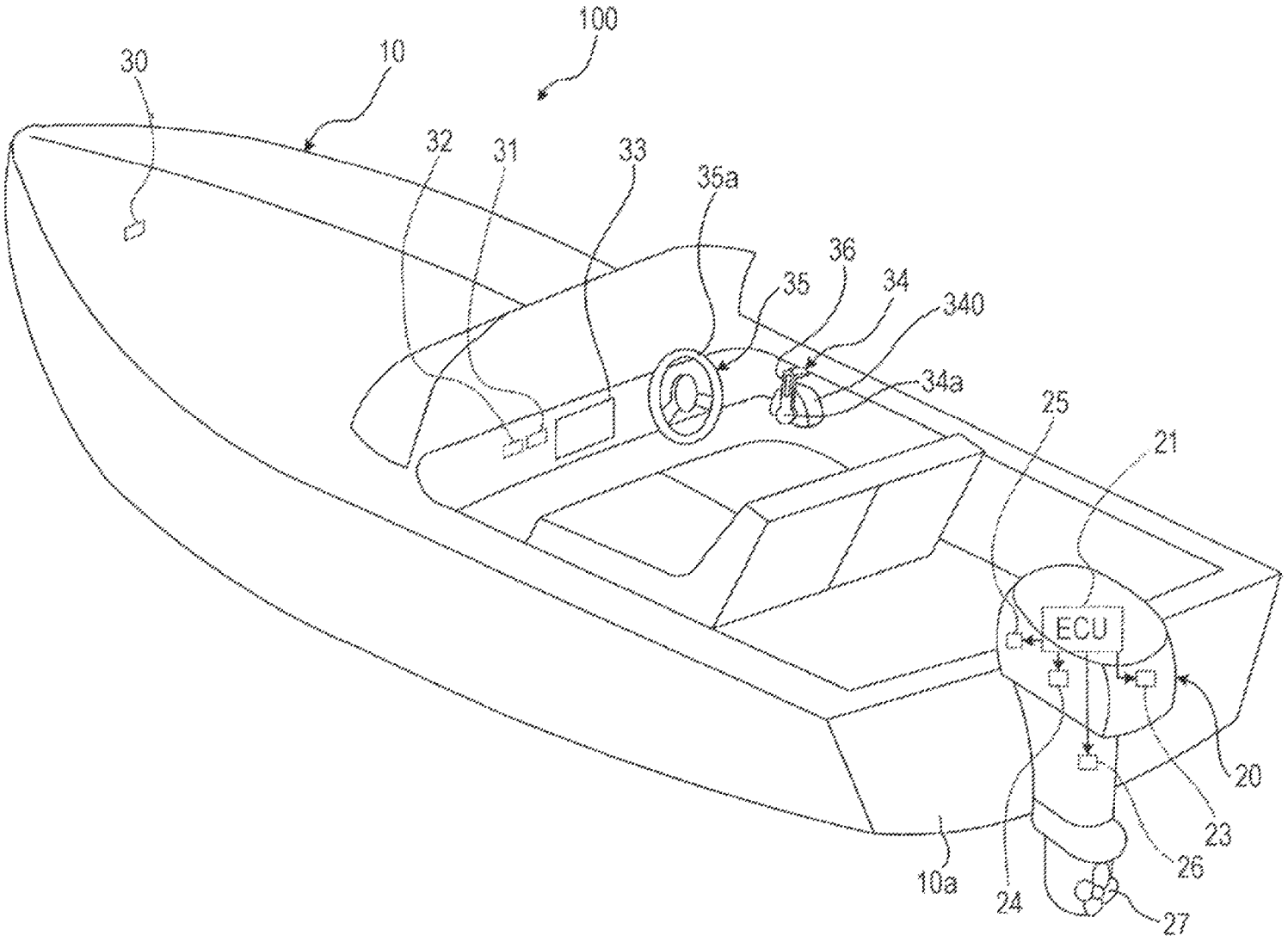
FIG. 1 is a schematic diagram illustrating an external configuration of a watercraft including an outboard motor control system being one embodiment of the present invention.
Figure 2:
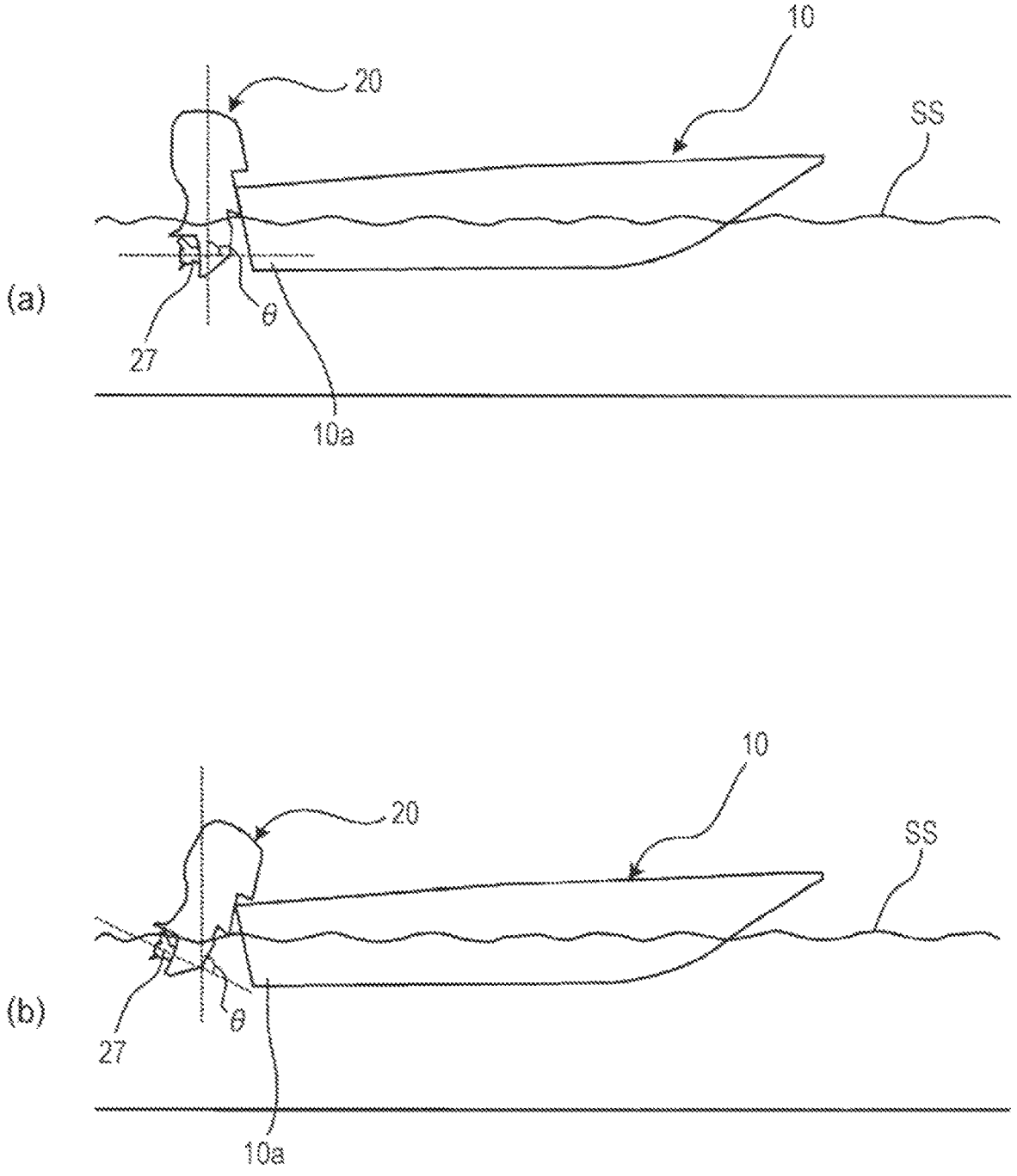
FIGS. 2(*a*) and 2(*h*) are schematic diagrams for explaining a trim angle.

FIG. 1 is a schematic diagram illustrating an external configuration of a watercraft 100 including an outboard motor control system being one embodiment of the present invention. FIGS. 2(*a*) and 2(*b*) are schematic diagrams for explaining a trim angle.

The watercraft 100 includes a hull 10, an outboard motor 20 attached to a stern 10*a* of the hull 10, a sonar 30 provided the hull 10, a direction sensor 31, a UPS (Global Positioning System) receiver 32, a display 33 configured with, for example, a liquid crystal display device, a shift/throttle operating device 34, a steering device 35, and a trim switch 36.

The sonar 10 is for measuring the depth of water within a predetermined area ahead of the bow of the hull 10 (in the travel direction of the watercraft 100 moving forward). Examples of the sonar 30 include an echo sounder (Echo Sounder), The information on the depth of water measured by the sonar 30 is transmitted to an ECU 21 of the outboard motor 20 described below.

The direction sensor 31 detects the direction where the bow of the hull 10 points, and outputs a signal indicating the direction. The signal outputted from the direction sensor 31 is transmitted to the ECU 21 of the outboard motor 20 described below.

The GPS receiver 32 detects the location of the hull 10 on the basis of signals received from UPS satellites, and outputs a signal indicating the location. The signal outputted from the UPS receiver 32 is transmitted to the ECU 21 of the outboard motor 20 described below.

The outboard motor 20 includes the ECU (Electronic Control Unit) 21, an unillustrated internal-combustion engine, a propeller 27 that rotates with power from the internal-combustion engine, a throttle motor 23, a steering motor 24, a trim angle adjustment motor 25, and a shift motor 26.

The throttle motor 23 is an actuator for driving a throttle valve of the internal-combustion engine to open and close.

The steering motor 24 is an actuator for driving a steering mechanism that rotates the outboard motor 20 about a vertical axis and changes the direction of the outboard motor 20 with respect to a direction linking the bow and the stern 10*a* of the hull 10.

The trim angle adjustment motor 25 is an actuator for driving a trim angle adjustment mechanism that adjusts such a trim angle θ (an angle formed by the direction of the rotation axis of the propeller 27 and the vertical direction) of the outboard motor 20 with respect to the hull 10 as exemplified in FIGS. 2(*a*) and 2(*b*). It is configured in such a manner that the trim angle θ can be changed within a range from equal to or greater than a first angle to equal to or less than a third angle by operating the trim angle adjustment motor 25.

FIG. 2(*a*) illustrates a state where the trim angle θ is, for example, the first angle. This state is a state where the propeller 27 and the stern 10*a* of the hull 10 are the closest to each other. As illustrated in FIG. 2(*b*), as the trim angle θ increases, the propeller 27 moves farther awn from the stern 10*a*, and closer to a water surface SS.

In this manner, the trim angle adjustment motor 25 functions as a driver for changing the attitude of the outboard motor 20 with respect to the hull 10 (in other words, the direction of the rotation axis of the propeller 27 and the distance from the propeller 27 to the stern 10*a*), Moreover, the ECU 21 and the trim angle adjustment motor 25 configure a control system for the outboard motor 20.

The shift motor 26 is an actuator for driving a shift mechanism that switches the rotational direction of the propeller 27 between forward and reverse directions.

It is configured in such a manner that the ECU 21 can be communicated with the sonar 30, the direction sensor 31, the GPS receiver 32, the display 33, the shift/throttle operating device 34, the steering device 35, and the trim switch 36 by wired or wireless communication.

The ECU 21 is connected to the sonar 30, the direction sensor 31, the GPS receiver 32, the display 33, the shift/throttle operating device 34, the steering device 35, and the trim switch 36 by, for example, a communication system specified by the NMEA (National Marine Electronics Association. National Marine Electronics Association) (for example, NMEA 2000, or more specifically, CAN (Controller Area Network)).

The shift/throttle operating device 34 is configured with an unillustrated rotary shaft that is rotatable supported in a remote control box 340 placed near a cockpit, a shift/throttle lever 34*a* that is attached to the rotary shaft and is capable of swinging operation in the front-and-back direction from an initial position, and an unillustrated lever position sensor placed in the remote control box 340.

The lever position sensor detects the position of the shift/throttle lever 34*a* operated by a watercraft operator (the angle of rotation of the rotary shaft of the shift/throttle operating device 34), and outputs a signal responsive to the operated position. The signal outputted from the lever position sensor is transmitted to the ECU 21.

The angle of rotation is, for example, zero degrees in a state where the shift/throttle lever 34*a* is in the initial position, changes up to, for example, 90 degrees in a state where the shift/throttle lever 34*a* is tilted forward of the initial position, and changes up to, for example, −90 degrees in a state where the shift/throttle lever 34*a* is tilted backward of the initial position.

The absolute value of the angle of rotation k f the rotary shaft of the shift/throttle operating device 34 and the degree of opening of the throttle valve of the internal-combustion engine of the outboard motor 20 are managed, associated with each other.

When having received the signal responsive to the angle of rotation of the rotary shaft of the shift/throttle operating device 34, the ECU 21 controls the throttle motor 23 in such a manner as to set the degree of opening of the throttle valve to a value corresponding to the absolute value of the angle of rotation. As the absolute value of the angle of rotation of the rotary shaft of the shift/throttle operating device 34 increases, the degree of opening of the throttle valve is controlled in such a manner as to increase, and the number of rotations of the propeller 27 increases.

The sign of the angle of rotation of the rotary shaft of the shift/throttle operating device 34 (the rotational direction of the shift/throttle lever 34*a*) and the rotational direction of the propeller 27 are managed, associated with each other.

For example, the angle of rotation with a plus sign is associated with a forward direction as the rotational direction of the propeller 27, and the angle of rotation with a minus sign is associated with a reverse direction as the rotational direction of the propeller 27. The forward rotation of the propeller 27 allows the hull 10 to move forward, and the reverse rotation of the propeller 27 allows the hull 10 to move backward.

When having received the signal responsive to the angle of rotation of the rotary shaft of the shift/throttle operating device 34, the ECU 21 controls the shift motor 26 in such a manner as to enter a state where the rotational direction of the propeller 27 corresponds to the rotational direction of the rotary shaft.

The steering device 35 includes a steering wheel 35*a* configured in such a manner as to be rotatable about a shaft as a rotation axis, and a steering angle sensor that is provided near the shaft, detects the steering angle of the steering wheel 35*a*, and outputs a signal responsive to the steering angle. The signal responsive to the steering angle outputted from the steering angle sensor is transmitted to the ECU 21.

The steering angle of the steering wheel 35*a* and the angle of rotation about the vertical axis of the outboard motor 20 are managed, associated with each other. When having received the signal responsive to the steering angle of the steering wheel 35*a*, the ECU 21 controls the steering motor 24 in such a manner as to set the angle of rotation of the outboard motor 20 to an angle of rotation corresponding to the steering angle.

The trim switch 36 is an operation interface for changing the trim angle θ. It is configured in such a manner that the trim, angle θ can be set at an arbitrary angle in a range from equal to ter greater than the first angle to equal to or less than a second angle by the operation of the trim switch 16. The second angle is a value less than the above third angle.

Figure 3:
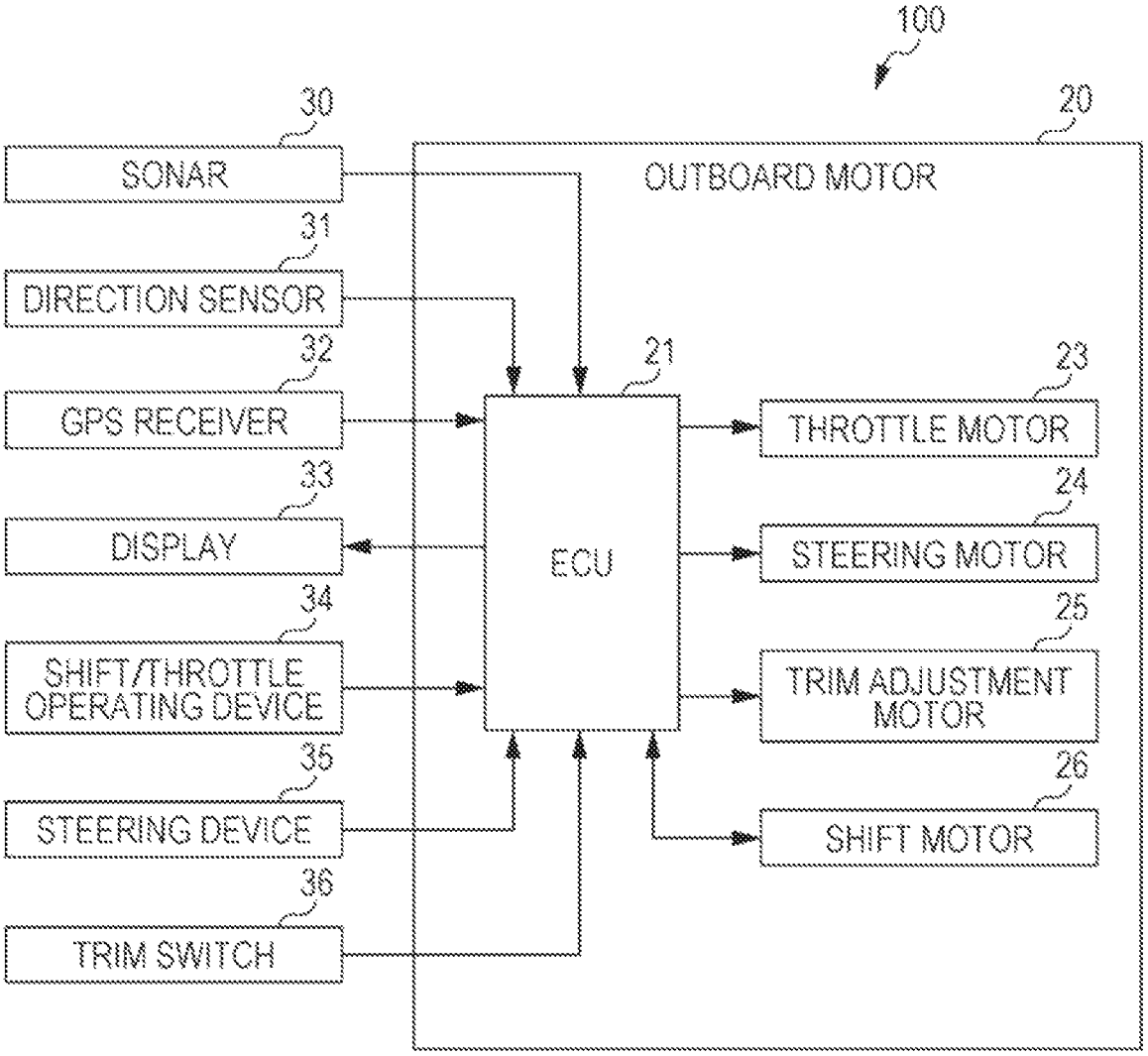
FIG. 3 is a block diagram illustrating a main part configuration of hardware of the watercraft illustrated in FIG. 1.

FIG. 3 is a block diagram illustrating a main part configuration of hardware of the watercraft 100 illustrated in FIG. 1.

The outboard motor 20 includes the ECU 21, the throttle motor 23, the steering motor 24, the trim angle adjustment motor 25, and the shift motor 26. The outboard motor 20 further includes the internal-combustion engine, the steering mechanism, the trim angle adjustment mechanism, and the propeller 27 although they are not illustrated in FIG. 3.

Figure 4:
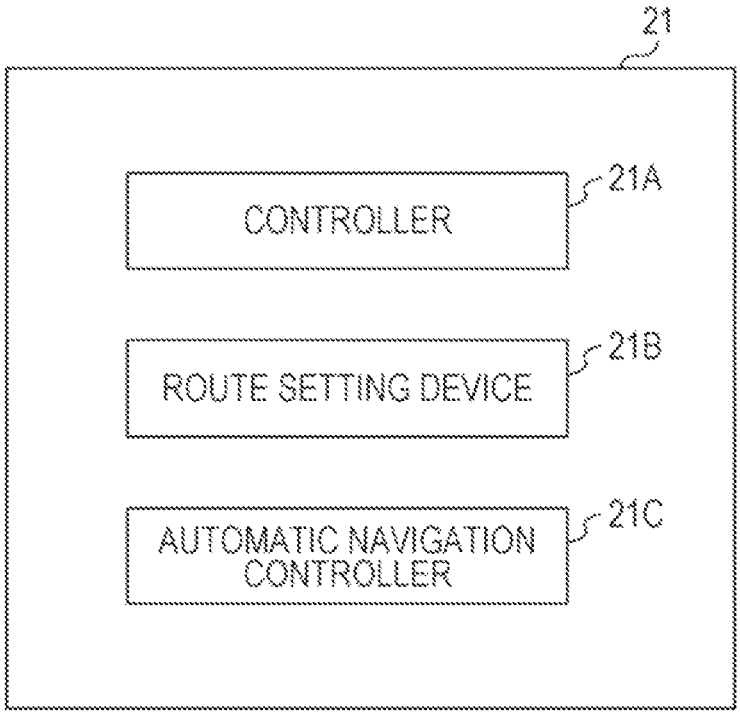
FIG. 4 is a diagram illustrating functional blocks of an ECU illustrated in FIG. 3.

The ECU 21 is configured with a microcomputer including a processor, ROM (Read Only Memory), and RAM (Random Access Memory), FIG. 4 is a diagram illustrating functional blocks of the ECU 21 illustrated in FIG. 3.

The ECU 21 functions as a controller 21A, a route setting device 21B, and an automatic navigation controller 21C by causing a processor to execute programs stored in the internal ROM and cooperating with various types of hardware of the outboard motor 20 and the watercraft 100.

The automatic navigation controller 21C controls the throttle motor 23, the steering motor 24, the trim angle adjustment motor 25, and the shift motor 26 without respect to a user's operation and steers the watercraft 100 automatically.

The route setting device 21B sets a route in a case where the automatic navigation controller 21C performs automatic steering. When information on a destination is inputted into the route setting device 21B by, for example, the operation of a touchscreen integrated with the display 33, the route setting device 21B sets a route according to the destination (a route from a current location to the destination) on the basis of information on the current location received from the GPS receiver 32 and the destination information, and stores information on the set route in the ROM, When instructed to start the automatic navigation, the automatic navigation controller 21C starts controlling the outboard motor 20 in accordance with the route information stored in the ROM.

The controller 21A selectively implements first control that controls the vertical position of the propeller 27 to a first position, and second control that controls the vertical position of the propeller 27 to a second position closer to a water surface than the first position. The controller 21A acquires, from the sonar 30, information on the depth of water a predetermined distance ahead in the travel direction of the watercraft 100, and decides which of the first control and the second control is implemented, on the basis of at least the information on the depth of water.

Each of the first and second positions is a position of the propeller 27 where thrust sufficient for the watercraft 100 to move forward can be obtained. However, the second position is on the water surface side with respect to the first position. Accordingly, when the propeller 27 is in a state of being in the second position, the thrust of the outboard motor 20 reduces and the travel resistance of the watercraft 100 increases as compared to a state where the propeller 27 is in the first position.

When implementing the first control, the controller 21A operates the trim angle adjustment motor 25 in such a manner as to set the trim angle θ to an arbitrary angle in the range from equal to or greater than the first angle to equal to or less than the second angle and accordingly controls the vertical position of the propeller 27 to the first position. The arbitrary angle may be a value specified by the watercraft operator, or a value determined automatically in such a manner as to be able to obtain the optimum ride comfort according to the navigation speed of the watercraft 100.

On the other hand, when implementing the second control, the controller 21A operates the trim angle adjustment motor 25 in such a manner as to set the trim angle θ to the above third angle and accordingly controls the vertical position of the propeller 27 to the second position. In other words, the trim angle θ under the second control is set at an angle outside the range of angles that can be set by manual operation.

Figure 5:
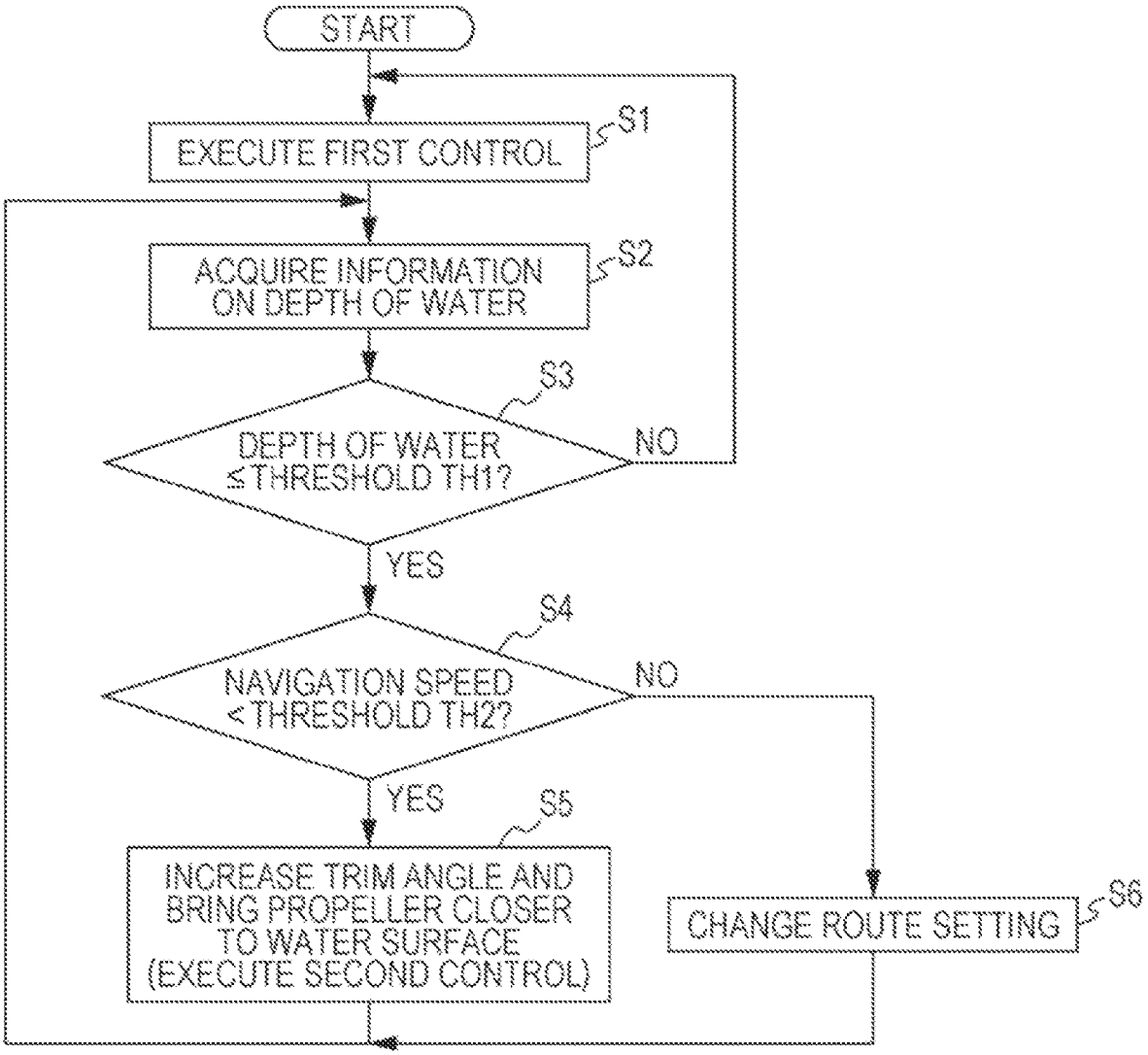
FIG. 5 is a flowchart for explaining the operation of the ECU illustrated in FIG. 3.

FIG. 5 is a flowchart for explaining the operation of the ECU 21 illustrated in FIG. 3. The operation of FIG. 5 indicates operation in a mode of the automatic navigation of the watercraft 100. In this operation, it is assumed that on the basis of a destination inputted by the watercraft operator, the route setting device 21B of the ECU 21 sets a route to the destination, and the route information is stored in the ROM.

When the setting of the route to the destination is complete and an instruction to start the automatic navigation has been given, the automatic navigation controller 21C of the ECU 21 starts automatic: navigation control. Under the automatic navigation control, the throttle motor 23, the steering, motor 24, the trim angle adjustment motor 25, and the shift motor 26 are controlled irrespective of the operation of the watercraft operator.

When having started the automatic navigation control, the controller 21A executes the first control, and controls the vertical position of the propeller 27 to the first position (step S1). When implementing the first control, the controller 21A, for example, operates the trim angle adjustment motor 25 in such a manner as to take the trim angle θ at which the optimum ride comfort according to the navigation speed of the watercraft 100 can be obtained, or operates the trim angle adjustment motor 25 in such a manner as to take the trim angle θ specified by the operation of the trim switch 36.

Next, the controller 21A acquires information on the depth of water a predetermined distance ahead in the travel direction of the watercraft 100, on the basis of information on the depth of water within a predetermined area received from the sonar 30 (step S2), The controller 21A then compares the acquired information on the depth of water with a predetermined threshold Till (step S3).

The threshold TH1 is a set upper limit to the depth of water where the propeller 27 of the outboard motor 20 may come into contact with the bottom of a body of water such as a lake, river, or sea bottom in a state where the trim angle θ is controlled at angles between equal to or greater than the first angle and equal to or less than the second angle.

If the information on the depth of water exceeds the threshold TH1 (step S3: NO), the controller 21A returns to step S1 and continues the first control. If the information on the depth of water is equal to or less than the threshold TH1 (step S3: YES), the controller 21A acquires information on the navigation speed of the watercraft 100, on the basis of, for example, information from the GPS receiver 32, or information from an unillustrated speedometer provided to the hull 10. The controller 21A then determines whether or not the acquired navigation speed is less than a predetermined threshold TH2 (step S4).

The threshold TH2 is set at, for example; a value slightly greater than a theoretical maximum value of the navigation speed of the watercraft 100 under the second control (for example, a value that is approximately 1.1 to 1.2 times the maximum value).

If having determined that the navigation speed is less than the threshold TH2 (step S4: YES), the controller 21A switches from the first control to the second control, and controls the vertical position of the propeller to the second position (step S5).

When having started the second control in step S5, the controller 21A implements feedback control that adjusts the number of rotations of the propeller 27, on the basis of the navigation speed of the watercraft 100, in such a manner as to maintain the navigation speed of the watercraft 100 immediately before the start of the second control. The controller 21A then returns execution to step S2 after step S5.

If having determined that the navigation speed is equal to or greater than the threshold TH2 (step S4: NO), the controller 21A continues the first control, and instructs the route setting device 21B to change the setting of the route. The instructed route setting device 2111 changes the route information stored in the ROM (step S6).

Specifically, the route setting device 21B determines the location of a body of water where the depth of water is equal to or less than the threshold TH, on the basis of the information received from the sonar 30, and changes the set route to a route that detours around the body of water where the depth of water is equal to or less than the threshold TH1, on the basis of the information on the body of water and the route information stored in the ROM. Execution returns to step S2 after step S6.

As described above, according to the watercraft 100, if the depth of water is shallow and the navigation speed is low, the second control is implemented. Hence, safe navigation can be performed, preventing the propeller 27 from coming into contact with the bottom of a body of water, even in an area of shallow water.

Moreover, if the second control is implemented, the propeller 27 approaches a water surface. Accordingly, the navigation speed may be reduced due to a reduction in the thrust of the outboard motor 20 and an increase in the travel resistance of the hull 10. However, the reduction of the navigation speed caused by the second control resulting from the implementation of the second control at low navigation speeds can be easily compensated with an increase in the number of rotations of the propeller 27. Hence, it is possible to achieve sale navigation over a shoal while preventing a reduction in navigation speed.

Moreover, according to the watercraft 100, the first control is continued even at a shallow depth of water if the navigation speed is high. If the second control is implemented, the navigation speed may be reduced described above. However, the continuation of the first control at high navigation speeds allows preventing a significant reduction in navigation speed and improving ride comfort, and also preventing an increase in the time taken to reach the destination.

Moreover, if the first control is continued in a state where it has been judged that the depth of water the predetermined distance ahead is shallow, the set route is changed to a route that detours around the area of shallow water. Hence, it is possible to continue safe navigation without contact of the propeller 27 with the bottom of the body of water.

Steps S4 and S6 are not absolutely necessary in the flowchart illustrated in FIG. 5. In this case, the operation is configured in such a manner as to perform the process of step S5 if the determination in step S3 is YES. While the process of step S5 is being performed, the ECU 21 disables the operation of the trim switch 36 to implement control in such a manner that the watercraft operator cannot change the trim angle θ. It is still possible to obtain the effect of safe navigation over a shoal even with such an operation.

Instead of the automatic navigation, mode, it may be configured in such a manner that the ECU 21 displays the route set by the route setting device 21B on t display 33, and the watercraft 100 may be equipped with a manual navigation mode in which the watercraft operator steers the watercraft 100 manually, following the route displayed on the display 33.

The operation of the manual navigation mode is the same as FIG. 5, except for differences in the point that it is controlled in such a manner that the watercraft operator cannot change the trim angle θ while the process of step S5 is being performed and the point that a change in the route information in step S6 leads to an update of the route displayed on the display 33 to a new route.

After step S6 is performed in manual navigation mode, the watercraft operator navigates the watercraft 100 following the new route, and accordingly can navigate to the destination without contact of the outboard motor 20 with a shoal and without a reduction in navigation speed.

Also in manual navigation mode, the operation may be configured in such a manner as to execute step S5 if the determination in step S3 is YES, deleting steps S4 and S6.

In the above-mentioned operation where steps S4 and S6 are deleted, if the process of step S5 is performed, it is preferable to display, on the display 33, a message, indicating that navigation is underway with the propeller 27 trimmed up to prevent the propeller 2 from corning into contact with a shoal, or to output the message by voice from a speaker.

Consequently, the second control is implemented, for example, in a state where the navigation speed is high, which, even if the navigation speed is suddenly reduced, enables the watercraft operator to grasp a reason for the sudden speed reduction and continue steering with peace of mind.

The controller 21A of the ECU 21 acquires the information on the depth of water from the sonar 30 in step S2. However, the method of acquiring information on the depth of water is not limited to this. For example, a communication interface that can access to the Internet may be mounted in advance on the watercraft 100, and the ECU 21 may acquire information on the depth of water in a body of water around the current location of the watercraft 100 via the Internet. In this case, it is possible to acquire information on a larger body of water at once than in a case of using the sonar 30, and to more correctly set a route that detours around the area of shallow water in step S6.

First Modification

Figure 6:
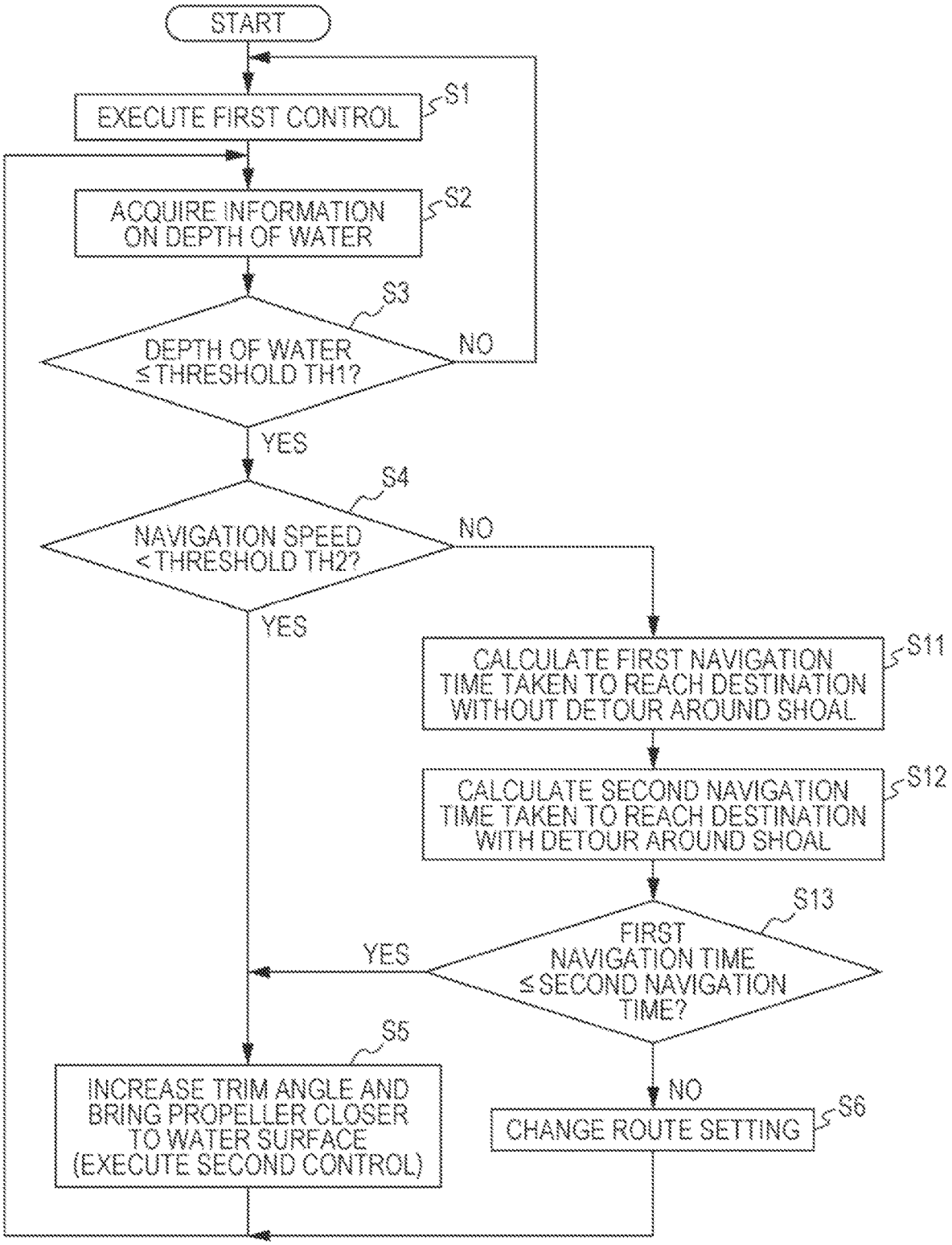
FIG. 6 is a flowchart for explaining a modification of the operation of the ECU illustrated in FIG. 3.

FIG. 6 is a flowchart for explaining a modification of the operation of the ECU 21 illustrated in FIG. 3. The flowchart illustrated in FIG. 6 is the same as FIG. 5, except for a point of addition of steps S11, S12, and S13. In FIG. 6, the same reference signs are assigned to the same processes as FIG. 5, and descriptions thereof are omitted.

If having determined that the navigation speed is equal to or greater than the threshold TH2 in step S4 (step S4: NO), the controller 21A obtains an overlapping area between the body of water where the depth of water is equal to or less than the threshold TH1, which has been determined on the basis of the information received from the sonar 30, and the route set by the route setting device 21B. The controller 21A than calculates first navigation time taken to reach the destination if navigating the overlapping area along the set route under the second control, and navigating the mute excluding the overlapping area under the first control (step S11).

In step S11, specifically, the controller 21A calculates first time required to pass through the overlapping area from the distance of the overlapping area in the travel direction and a theoretical maximum value of the navigation speed under the second control. Furthermore, the controller 21A calculates second time required to pass along the route excluding the overlapping area from a distance obtained by subtracting the distance of the above overlapping area from a distance to the destination along the route and a navigation speed predetermined for the first control. The controller 21A then adds the first and second times and obtains the first navigation time.

After step S11, the controller 21A obtains a temporary route obtained by changing the route set by the route setting device 21B and stored in the ROM to a route that detours around the above overlapping area. The controller 21A then calculates second navigation time taken to reach the destination in a case of navigating the temporary route under the first control (step S12).

In step S12, specifically, the controller 21A calculates the time required to move to the destination following the temporary route, as the second navigation time, from a distance between a current location and the destination along the temporary route and the navigation speed predetermined for the first control.

The controller 21A then compares the first and second navigation times and, if the first navigation time is equal to or less than the second navigation time (step S13: YES), performs the process of step S5. The controller 21A causes the route setting device 21B to perform the process of step S6 if the first navigation time exceeds the second navigation time (step S13: NO).

As described above, according to the operation of the modification, if the first navigation time is equal to or less than the second navigation time, in other words, if the navigation time taken to head for the destination through the area of shallow water is not greater than the navigation time taken to head for the destination with a detour around the area of shallow water, the area of shallow water is navigated under the second control.

In the case of navigating in the area of shallow water under the second control, the navigation speed equal to or greater than the threshold TH2 may be reduced. However, if the time required to reach the destination is equal to or less than the second navigation time even at lower navigation speed, the implementation of the second control allows preventing the time required to reach the destination from increasing. Moreover, passing through the area of shallow water following the set route allows preventing the travel direction of the watercraft 100 from changing greatly, and increasing the ride comfort of the watercraft 100.

Moreover, according to the operation of the modification, if the first navigation time exceeds the second navigation time, in other words, if heading for the destination with the detour around the area of shallow water reduces the navigation time as compared to heading for the destination through the area of shallow water, the set route is changed to the route that detours around the area of shallow water. Hence, it is possible to prevent an increase in the time taken to reach the destination.

Second Modification

Figure 7:
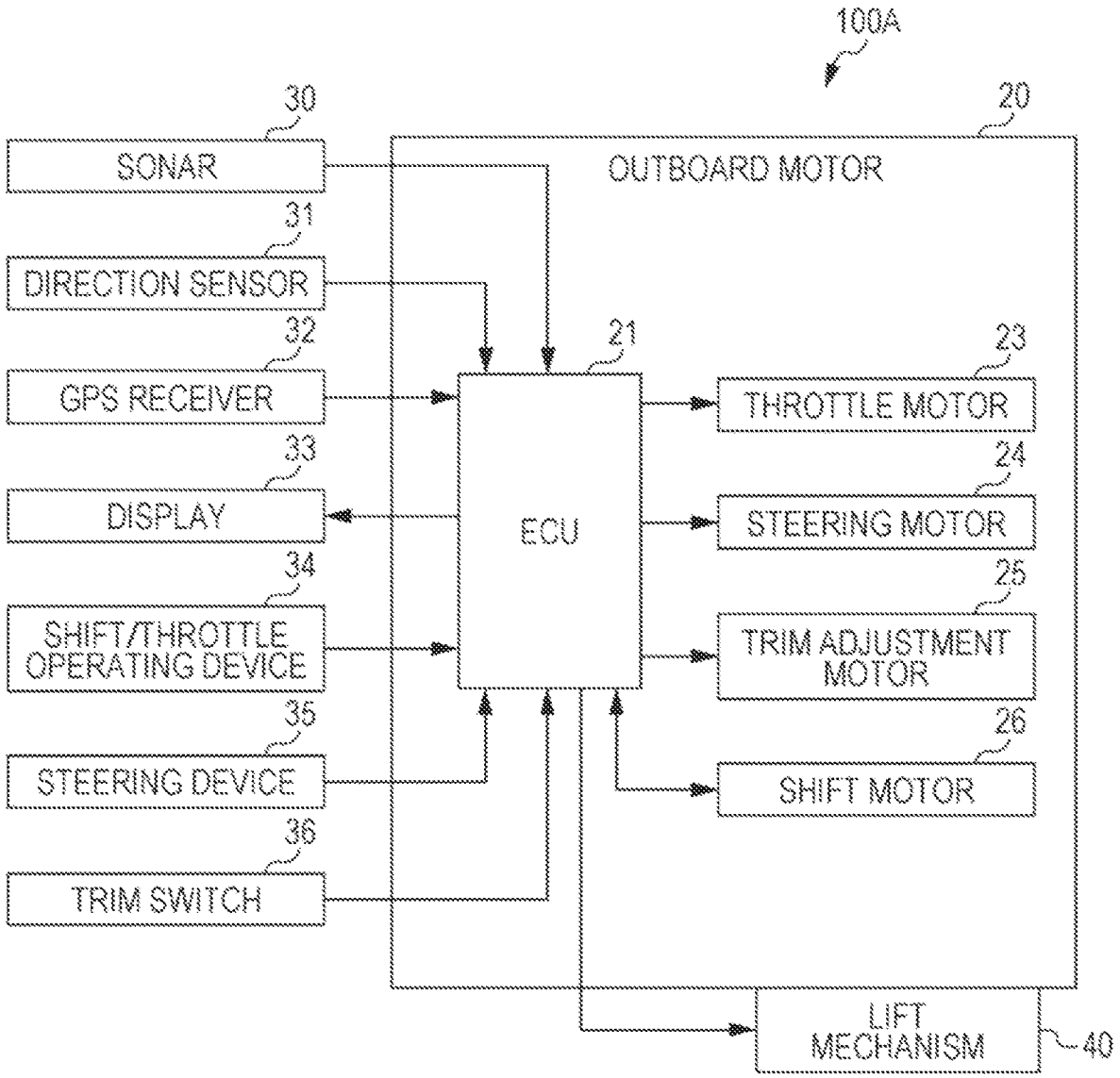
FIG. 7 is a block diagram illustrating a main part configuration of hardware of a watercraft according to a second modification.

FIG. 7 is a block diagram illustrating a main part configuration of hardware of a watercraft 100A being a modification of the watercraft 100 illustrated in FIG. 1. The watercraft 100A has the same configuration as the watercraft 100 illustrated in FIG. 3, except for a point of addition of a lift mechanism 40 for lifting the outboard motor 20 up and down with respect to the hull 10 (moving the outboard motor 20 in the vertical direction).

The lift mechanism 40 is a mechanism for moving the outboard motor 20 in the vertical direction by use of a motor, a hydraulic cylinder, or the like. The motor or hydraulic cylinder included in the lift mechanism 40 functions as a driver for changing the attitude of the outboard motor 20 with respect to the hull 10, For example, the one described in JP-A-2007-29064 can be used for the lift mechanism 40.

The controller 21A of the ECU 21 in the watercraft 100A is the same as in the watercraft 100 in the point of selectively implementing the first control and the second control. However, when implanting the first control, the controller 21A of the watercraft 100A operates the motor or hydraulic cylinder of the lift mechanism 40, moves the outboard motor 20 to a reference position, and accordingly controls the vertical position of the propeller 27 to a first position.

Moreover, when implementing the second control, the controller 21A of the watercraft 100A operates the motor or hydraulic cylinder of the lift mechanism 40, moves the outboard motor 20 to a higher position than the reference position, and accordingly controls the vertical position of the propeller 27 to a second position closer to the water surface than the first position.

Figure 8:
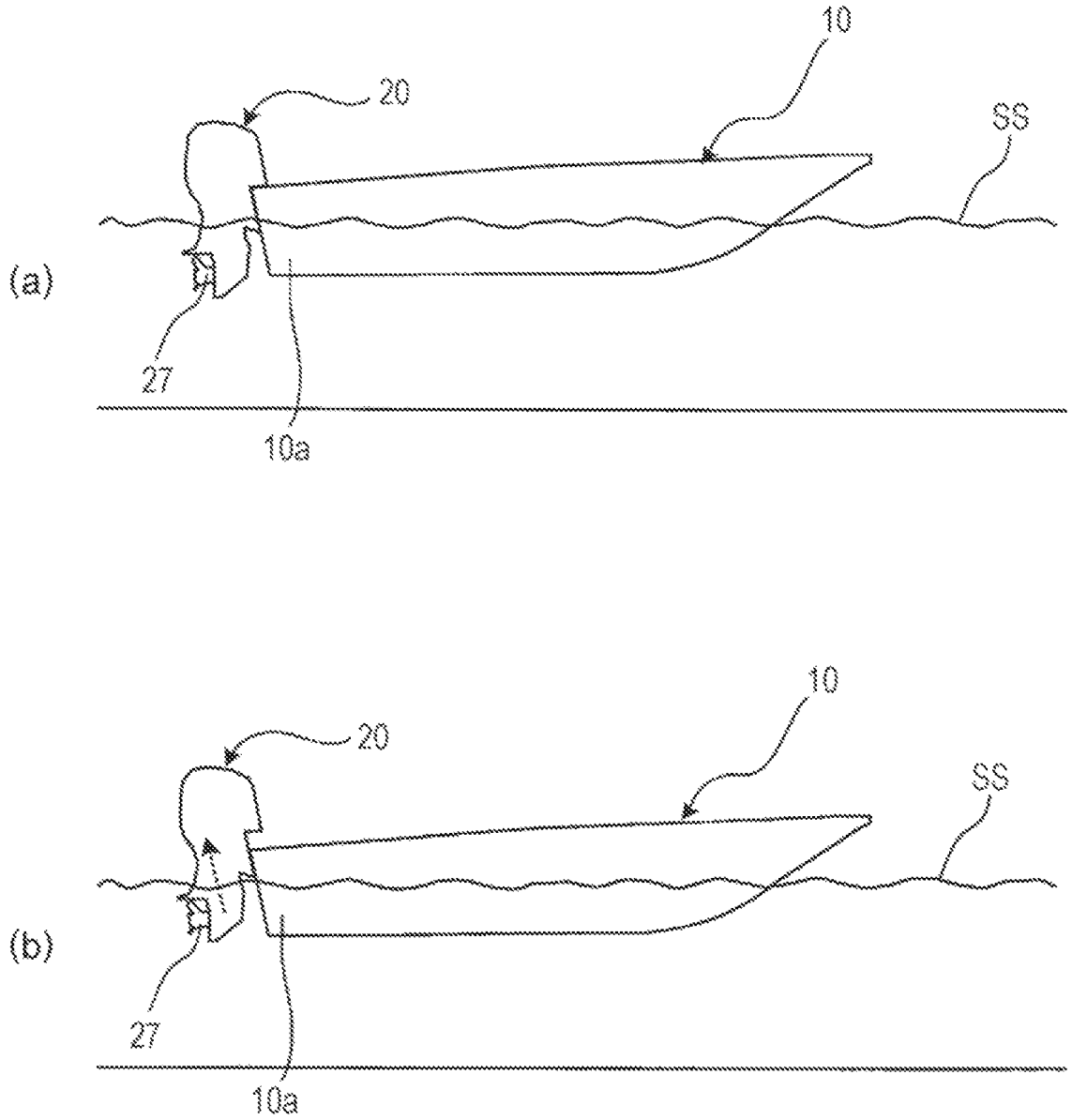
FIGS. 8(*a*) and 8(*b*) are diagrams exemplifying the attitude of an outboard motor under first control and second control m the watercraft illustrated in FIG. 7.

FIG. 8(*a*) is a diagram exemplifying the attitude of the outboard motor 20 wider the first control in the watercraft 100A illustrated in FIG. 7. FIG. 8(*b*) is a diagram exemplifying the attitude of the outboard motor 20 under the second control in the watercraft 100A illustrated in FIG. 7.

The outboard motor 20 moves upward in the vertical direction from a state where the outboard motor 20 is in the reference position as illustrated in FIG. 8(*a*). The propeller 27 moves toward the water surface SS and then to the second position as illustrated in FIG. 8(*b*). The second position is on the water surface SS side with respect to the vertical position of the propeller 27 in a state where the outboard motor 20 is in the reference position and in a state where the trim angle θ is at a maximum value in a manually settable range.

Figure 9:
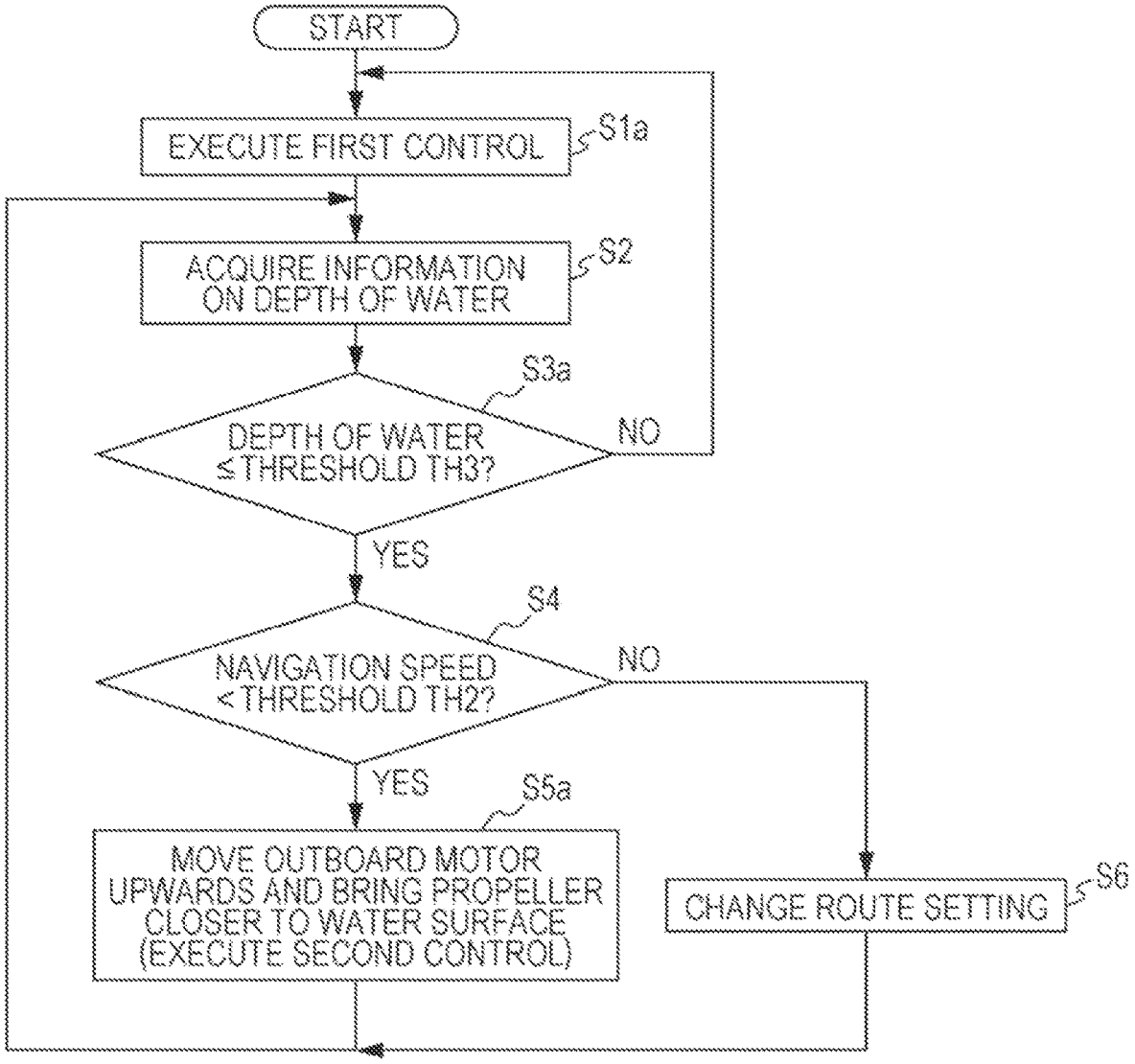
FIG. 9 is a flowchart for explaining the operation of the ECU of the watercraft illustrated in FIG. 7.

FIG. 9 is a flowchart for explaining the operation of the ECU 21 of the watercraft 100A illustrated in FIG. 7, the flowchart illustrated in FIG. 9 is the same as FIG. 5, except for a point where step S1 is changed to step S1*a*, a point where step S3 is changed to step S3*a*, and a point where step S5 is changed to step S5*a*, In FIG. 9, the same reference signs are assigned to the same processes as FIG. 5, and descriptions thereof are omitted.

In step S1*a*, the controller 21A implements first control Mat operates the motor or hydraulic cylinder of the lift mechanism 40 and moves the outboard motor 20 to the reference position. The trim angle θ can be set at an arbitrary value in the range from equal to or greater than the first angle to equal to or less than the second angle in the state where the outboard motor 20 is in the reference position.

When having acquired the information on the depth of water in step S2 after step S1*a*, the controller 21A compares the acquired information on the depth of water with a predetermined threshold TH3 (step S3*a*) The threshold TH3 is a set upper limit to the depth of water where the outboard motor 20 may come into contact with the bottom of a body of water in the state where the outboard motor 20 is in the reference position.

If the information on the depth of water exceeds the threshold TED (step S3*a*: NO), the process of step S1*a* is continued. If the information on the depth of water is equal to or less than the threshold TH3 (Step S3*a*: YES), the process of step S4 is performed.

If the determination in step S4 is YES, the controller 21A implements second control that operates the motor or hydraulic cylinder of the lift mechanism 40 and moves the outboard motor 20 to a higher position than the reference position (step S5*a*). After step S5*a*, execution returns to step S2.

The controller 21A fixes the trim angle θ at a previously set value or, for example, a minimum value during the implementation of the second control. The trim angle θ is fixed at the minimum value during the second control, Which allows maximizing the thrust of the s outboard motor 20.

In this manner, the configuration that moves the outboard motor 20 in the vertical direction and changes the vertical position of the propeller 27 also allows obtaining the same effects as the watercraft 100. Steps S4 and S6 in the flowchart of FIG. 9 are not absolutely necessary in the watercraft 100A, either. If the determination in step S3*a* is YES, then step S5*a* may be performed.

Third Modification

Figure 10:
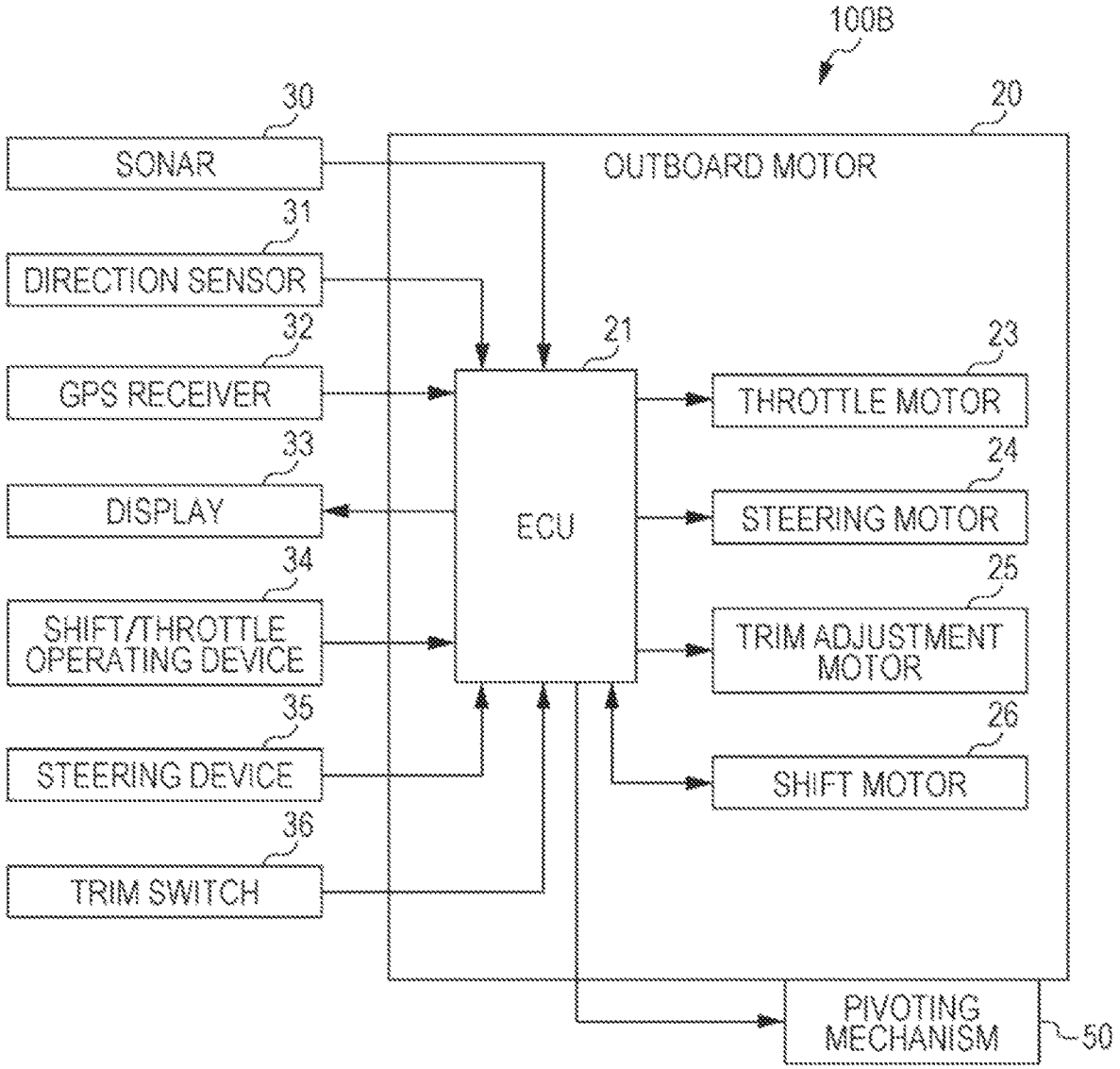
FIG. 10 is a block diagram illustrating a main pan configuration of hardware of a watercraft according to a third modification.

FIG. 10 is a block diagram illustrating a main part configuration of hardware of a watercraft 100B being a modification of the watercraft. 100 illustrated in FIG. 1. The watercraft 100E has the same configuration as the watercraft 100 illustrated in FIG. 3, except for a point of addition of a pivoting mechanism 50 for causing the outboard motor 20 to pivot with respect to the hull 10.

The pivoting mechanism 50 is a mechanism for rotating the outboard motor 20 about the rotation axis thereof (an axis parallel to the rotation axis of the propeller 27) by use of a motor, hydraulic cylinder, or the like. The motor or hydraulic system included in the pivoting mechanism 50 functions as a driver for changing the attitude of the outboard motor 20 with respect to the hull 10.

The controller 21A of the ECU 21 in the watercraft 100B is the same as in the watercraft 100 in the point of selectively implementing the first control and the second control. However, when implementing the first control, the controller 21A of the watercraft 100B operates the motor or hydraulic cylinder of the pivoting mechanism 50, moves the outboard motor 20 to a reference position, and accordingly controls the vertical position of the propeller 27 to a first position.

Moreover, when implementing the second control, the controller 21A of the watercraft 100B operates the motor or hydraulic cylinder of the pivoting mechanism 50, moves the outboard motor 20 to a pivot position pivoted from the reference position, and accordingly controls the vertical position of the propeller 27 to a second position closer to the water surface than the first position.

Figure 11:
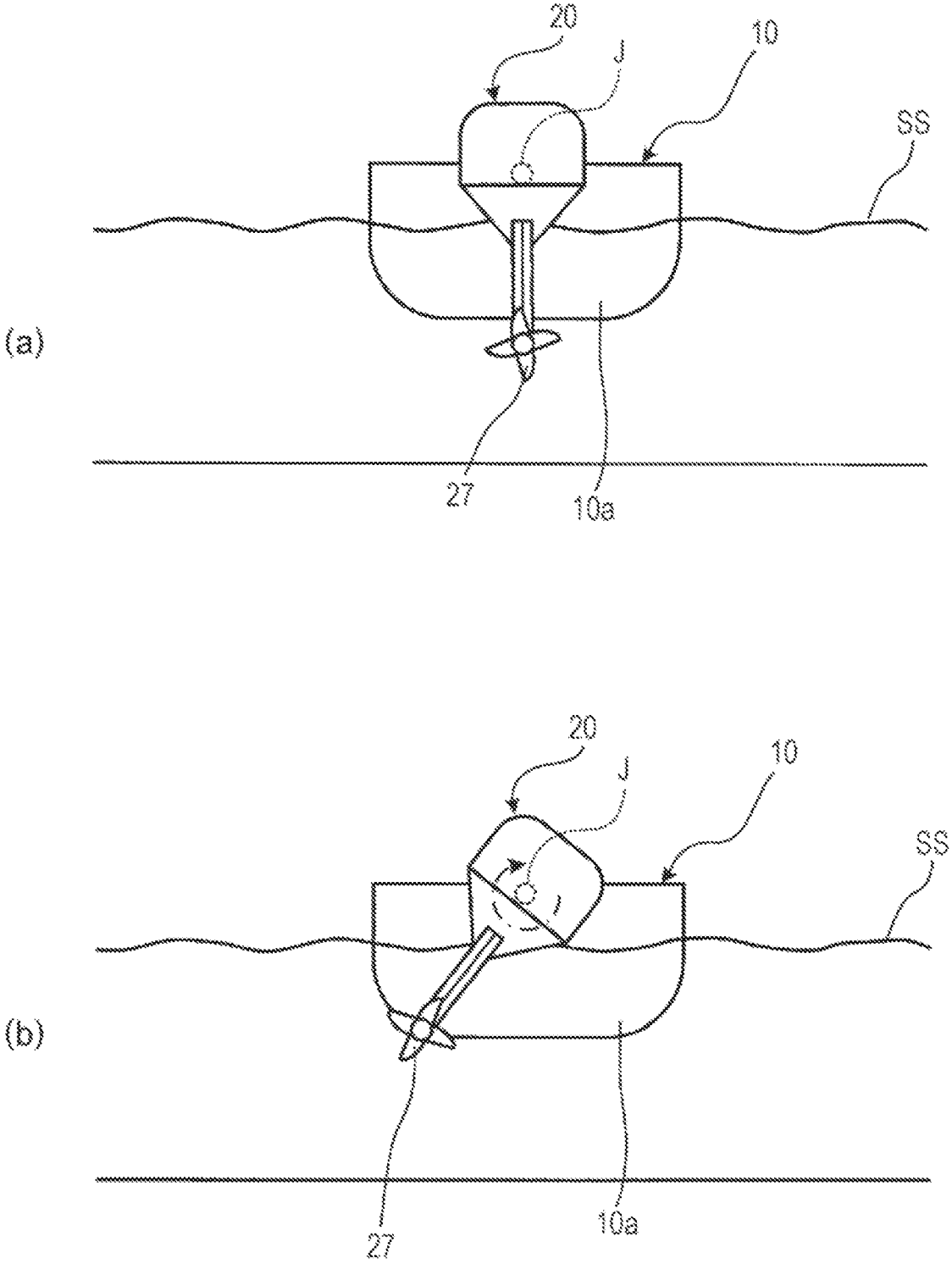
FIGS. 11(*a*) and 11(*b*) are diagrams exemplifying the attitude of the outboard motor under the first control and the second control in a watercraft illustrated in FIG. 10.

FIGS. 11(*a*) and 11(*b*) are diagrams exemplifying the attitude of the outboard motor under the first control and the second control in the watercraft illustrated in FIG. 10, A rotation axis J of the outboard motor 20 is illustrated in FIGS. 11(*a*) and 11(*b*).

FIG. 11(*a*) is a diagram exemplifying the attitude of the outboard motor 20 in a state where the first control has been implemented by the operation of the pivoting mechanism 50. FIG. 11(*b*) is a diagram exemplifying the attitude of the outboard motor 20 in a state where the second control has been implemented by the operation of the pivoting mechanism 50. The outboard motor 20 operates the motor, hydraulic cylinder, or the like of the pivoting mechanism 50 to pivot about the rotation axis parallel to the direction of the rotation axis of the propeller 27.

As illustrated in FIG. 11(*a*), a state where the direction in which the rotation axis of the propeller 27 and the rotation axis J are aligned agrees with the vertical direction as viewed m the direction of the rotation axis of the propeller 27 is assumed to be the reference position of the outboard motor 20. In the stale where the outboard motor 20 is in the reference position, the trim angle θ can be set at an arbitrary value in the range from equal to or greater than the first angle to equal to or less than the second angle.

As illustrated in FIG. 11(*b*), a state where the direction in which the rotation axis of the propeller 27 and the rotation axis stare aligned intersects with the vertical direction as viewed in the direction of the rotation axis of the propeller 27 is assumed to be the pivot position of the outboard motor 20. In the state where the outboard motor 20 is in the pivot position, the trim angle θ is fixed at an arbitrary value in the range from equal to or greater than the first angle to equal to or less than the second angle.

The second position being the vertical position of the propeller 27 in the state of FIG. 11(*b*) is on the water surface SS side with respect to the first position being the vertical position of the propeller 27 in a state where the outboard motor 20 is in the reference position and in a state where the trim angle θ is at a maximum value in a manually settable range.

Figure 12:
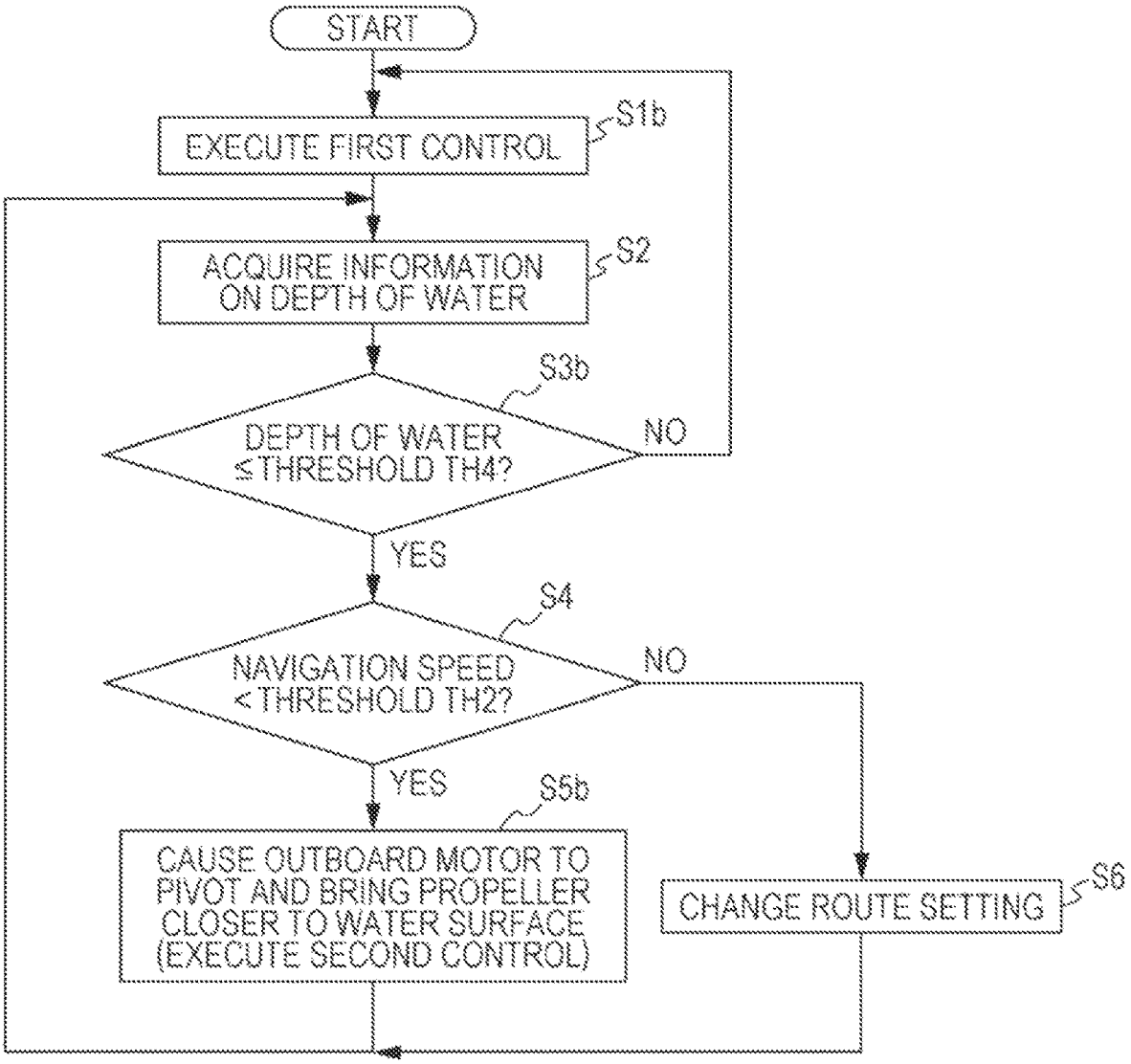
FIG. 12 is a flowchart for explaining the operation of the ECU of the watercraft illustrated in FIG. 10.

FIG. 12 is a flowchart for explaining the operation of the ECU 21 of the watercraft 100B illustrated in FIG. 10. The flowchart illustrated in FIG. 12 is the same as FIG. 5, except for a point where step S1 is changed to step S1*b*, a point where step S3 is changed to step S3*b* and a point where step S5 is changed to step S5*b*. In FIG. 12, the same reference signs are assigned to the same processes as FIG. 5, and descriptions thereof are omitted.

In step S1*b*, the controller 21A implements first control that operates the motor or hydraulic cylinder of the pivoting mechanism 50 and moves the outboard motor 20 to the reference position. The trim angle θ can be set at an arbitrary value in the range from equal to or greater than the first angle to equal to or less than the second angle in the state where the outboard motor 20 is in the reference position.

After acquiring the information on the depth of water in step S2 after step S1*b*, the controller 21A compares the acquired information on the depth of water with a predetermined threshold TH4 (step S3*b*). The threshold TH4 is a set upper limit to the depth of water where the outboard motor 20 may come into contact with the bottom of a body of water in the state where the outboard motor 20 is in the reference position.

If the information on the depth of water exceeds the threshold TH4 (step S3*b*: NO), the process of step S1*b* is continued. If the information on the depth of water is equal to or less than the threshold TH4 (step S3*b*: YES), the process of step S4 is performed.

If the determination in step S4 is YES, the controller 21A implements second control that operates the motor or hydraulic cylinder of the pivoting mechanism 50 and moves the outboard motor 20 to the pivot position (step S5*b*). After step S5*b*, execution returns to the process of step S2.

The controller 21A fixes the trim angle θ at a previously set value or, for example, a minimum value during the implementation of the second control. The trim angle θ is fixed at the minimum value during the second control, which allows maximizing the thrust of the outboard motor 20.

In this manner, the configuration that causes the outboard motor 20 to pivot and changes the vertical position of the propeller 27 also allows obtaining the same effects as the watercraft 100. Steps S4 and S6 in the flowchart of FIG. 12 are not absolutely necessary in the watercraft 100B, either. If the determination in step S3*b* is YES, then step S5*b* may be performed.

The present invention is not limited to the above-mentioned embodiments, to which a modification, improvement, and the like can be made as appropriate. For example, in the watercraft 100, 100A, and 100B that have been described up to this point, the functions of the controller 21A, the route setting device 21B, and the automatic navigation controller 21C of the ECU 21 may be realized by another ECU provided outside the outboard motor 20 (for example, an ECU of the watercraft 100).

As described above, the following matters are disclosed in the description:

(1)

A control system for an outboard motor (for example, the outboard motor 20 in the above-mentioned embodiment) that includes a propeller (for example, the propeller 27 in the above-mentioned embodiment and is attached to a stern (for example, the stern 10*a* in the above-mentioned embodiment) of a watercraft (for example, the watercraft 100 in the above-mentioned embodiment), the control system including:

a driver (for example, the trim angle adjustment motor 25 in the above-mentioned embodiment) for changing the attitude of the outboard motor with respect to the watercraft; and a controller (for example, the controller 21A in the above-mentioned embodiment) configured to selectively implement first control that operates the driver and controls the vertical position of the propeller to a first position, and second control that operates the driver and controls the vertical position of the propeller to a second position closer to a water surface than the first position, in which the controller acquires information on the depth of water a predetermined distance ahead in the travel direction of the watercraft, and determines which of the first control and the second control is implemented, on the basis of at least the information on the depth of water.

According to (1), either the first control or the second control is implemented on the basis of at least the information on the depth of water. If the second control is implemented, the propeller becomes unlikely to come into contact with a sea bottom as compared to a case where the first control is implemented. Hence, for example, if the depth of water is shallow, the second control is implemented; accordingly, it is possible to safely navigate the watercraft even over a shoal.

(2)

The control system for the outboard motor according to (1), in which the controller implements the second control upon the information on the depth of water being equal to or less than a predetermined first threshold, and implements the first control upon the information on the depth of water exceeding the first threshold.

According to (2), if the depth of water is shallow, then the second control is implemented; accordingly, it is possible to safely navigate the watercraft even over a shoal.

(3)

The control system for the outboard motor according to (1), in which the controller determines which of the first control and the second control is implemented, on the basis of the information on the depth of water and the navigation speed of the watercraft.

According to (3), which of the first control and the second control is implemented is determined on the basis of the information on the depth of water and the navigation speed; accordingly, it is possible to implement the optimum control according to the situation and enable efficient navigation.

(4)

The control system for the outboard motor according to (3), in which the controller implements the second control upon the information on the depth of water being equal to or less than a predetermined first threshold and the navigation speed being less than a predetermined second threshold.

According to (4), if the depth of water is shallow and the navigation speed is low, then the second control is implemented. If the second control is implemented, the propeller approaches the water surface; accordingly, the navigation speed may be reduced due to a reduction in the thrust of the outboard motor and an increase in travel resistance. However, the reduction of the navigation speed caused by the second control resulting from the implementation of the second control at low navigation speeds can be easily compensated with an increase in the number of rotations of the propeller. Hence, it is possible to achieve safe navigation over a shoal while preventing a reduction in navigation speed.

(5)

The control system for the outboard motor according to (4), further including a route setting device (for example, the route setting device 21B in the embodiments described above) configured to set a route according to a destination of the watercraft, in which upon the information on the depth of water being equal to or less than the first threshold and the navigation speed being equal to or greater than the second threshold, the controller implements the first control, and the route setting device changes the set route to a route that detours an area where the depth of water is equal to or less than the first threshold.

According to (5), if the navigation speed is high, not the second control but the first control is implemented. Accordingly, it is possible to prevent a reduction in navigation speed and prevent an increase in the time taken to reach the destination. Moreover, in this case, the route is changed so that it is possible to continue navigation without passing, through the area of shallow water.

(6)

The control system for the outboard motor according to (4), further including a route setting device (for example, the route setting device 21B in the embodiments described above) configured to set a route according to a destination of the watercraft, in Which upon the information on the depth of water being equal to or less than the first threshold and the navigation speed being equal to or greater than the second threshold, the controller calculates first navigation time taken to reach the destination in a case of navigation under the second control through an area where the depth of water is equal to or less than the first threshold on the route set by the route setting device, and second navigation time taken to reach the destination in a case of navigation under the first control along a changed route that detours the area where the depth of water is equal to or less than the first threshold, which is changed from the route set by the route setting device, and, upon the first navigation time being equal to or less than the second navigation time, implements the second control.

According to (6) if the first navigation time in the case of navigating to the destination through the area of shallow water under the second control is equal to or less than the second navigation time required in the case of navigating to the destination with a detour around the area of shallow water under the first control, the area of shallow water is navigated. If the area of shallow water is navigated under the second control, the navigation speed equal to or greater than the second threshold may be reduced. However, even if the navigation speed is reduced, when the time required to reach the destination is equal to or less than the second navigation time, the implementation of the second control allows preventing the travel direction of the watercraft from changing greatly while preventing an increase in the time taken to reach the destination, and improving the ride comfort of the watercraft.

(7)

The control system for the outboard motor according to (6), in which the controller implements the first control upon the first navigation time exceeding the second navigation time, and the route setting device changes the set route to the route that detours the area where the depth of water is equal to or less than the first threshold upon the first navigation time exceeding the second navigation time.

According to (7), it is possible to prevent an increase in the time taken to reach the destination.

(8)

The control system for the outboard motor according to any of (1) to (7), in which the driver is for changing the trim angle of the outboard motor.

According to (8), it is possible to change the vertical position of the propeller by changing the trim angle.

(9)

The control system for the outboard motor according to any of (1) to (7), in which the driver is for moving the outboard motor in the vertical direction (for example, the motor of the lift mechanism 40 in the above-mentioned embodiment).

According to (9), the outboard motor is moved in the vertical direction; accordingly, the vertical position of the propeller can be changed.

(10)

The control system for the outboard motor according to any of (1) to (7) in which the driver is for causing the outboard motor to pivot about the rotation axis thereof extending in a direction parallel to the rotation axis of the propeller (for example, the motor of the pivoting mechanism 50 in the above-mentioned embodiment).

According to (10), the outboard motor is caused to pivot about the rotation axis; accordingly, the vertical position of the propeller can be changed.

LIST OF REFERENCE SIGNS

100, 100A, 100B Watercraft
10 Hull
10*a* Stern
20 Outboard motor
21 ECU
21A Controller
21B Route setting device
21C Automatic navigation controller
23 Throttle motor
24 Steering motor
25 Trim angle adjustment motor
26 Shift motor
27 Propeller
30 Sonar
31 Direction sensor
32 GPS receiver
33 Display
34 Shift/throttle operating device
34*a* Shift/throttle lever
340 Remote control box
35 Steering device
35*a* Steering wheel
36 Trim switch
40 Lift mechanism
50 Pivoting mechanism
SS Water surface
θ Trim angle
J Rotation axis

The invention claimed is:

1. A control system for an outboard motor that includes a propeller and is attached to a stern of a watercraft, the control system comprising:

a driver for changing an attitude of the outboard motor with respect to the watercraft; and a controller configured to selectively implement first control that operates the driver and controls a vertical position of the propeller to a first position, and second control that operates the driver and controls the vertical position of the propeller to a second position closer to a water surface than the first position, a route setting device configured to set a route according to a destination of the watercraft, wherein the controller acquires information on a depth of water a predetermined distance ahead in a travel direction of the watercraft, and determines which of the first control and the second control is implemented, based upon the information on the water depth and a navigation speed of the watercraft, the controller implements the second control upon the information on the depth of water being equal to or less than a predetermined first threshold and the navigation speed being less than a predetermined second threshold, and upon the information on the depth of water being equal to or less than the first threshold and the navigation speed being equal to or greater than the second threshold, the controller implements the first control, and the route setting device changes the set route to a route that detours an area where the depth of water is equal to or less than the first threshold.

2. A control system for an outboard motor that includes a propeller and is attached to a stern of a watercraft, the control system comprising:

a driver for changing an attitude of the outboard motor with respect to the watercraft; and a controller configured to selectively implement first control that operates the driver and controls a vertical position of the propeller to a first position, and second control that operates the driver and controls the vertical position of the propeller to a second position closer to a water surface than the first position, a route setting device configured to set a route according to a destination of the watercraft, wherein the controller acquires information on a depth of water a predetermined distance ahead in a travel direction of the watercraft, and determines which of the first control and the second control is implemented, based upon the information on the water depth and a navigation speed of the watercraft, the controller implements the second control upon the information on the depth of water being equal to or less than a predetermined first threshold and the navigation speed being less than a predetermined second threshold, and upon the information on the depth of water being equal to or less than the first threshold and the navigation speed being equal to or greater than the second threshold, the controller calculates first navigation time taken to reach the destination in a case of navigation under the second control through an area where the depth of water is equal to or less than the first threshold on the route set by the route setting device, and second navigation time taken to reach the destination in a case of navigation under the first control along a changed route that detours the area where the depth of water is equal to or less than the first threshold, which is changed from the route set by the route setting device, and, upon the first navigation time being equal to or less than the second navigation time, implements the second control.

3. The control system for the outboard motor according to claim 2, wherein the controller implements the first control upon the first navigation time exceeding the second navigation time, and the route setting device changes the set route to the route that detours the area where the depth of water is equal to or less than the first threshold upon the first navigation time exceeding the second navigation time.

4. The control system for the outboard motor according to claim 1, wherein the driver is for changing a trim angle of the outboard motor.

5. The control system for the outboard motor according to claim 1, wherein the driver is for moving the outboard motor in a vertical direction.

6. The control system for the outboard motor according to claim 1, wherein the driver is for causing the outboard motor to pivot about a rotation axis thereof extending in a direction parallel to a rotation axis of the propeller.

7. The control system for the outboard motor according to claim 1, wherein the second threshold is a value greater than a maximum value of the navigation speed of the watercraft under the second control.

8. The control system for the outboard motor according to claim 1, wherein the second threshold is a value of 1.2 times of the maximum value of the navigation speed of the watercraft under the second control.

9. The control system for the outboard motor according to claim 2, wherein the driver is for changing a trim angle of the outboard motor.

10. The control system for the outboard motor according to claim 2, wherein the driver is for moving the outboard motor in a vertical direction.

11. The control system for the outboard motor according to claim 2, wherein the driver is for causing the outboard motor to pivot about a rotation axis thereof extending in a direction parallel to a rotation axis of the propeller.

* * * * *